US005205641A

United States Patent [19]

Albrecht

[11] Patent Number: 5,205,641

[45] Date of Patent: Apr. 27, 1993

[54] SOCKET FOR A MINIATURE INCANDESCENT LAMP

[76] Inventor: Paul Albrecht, Stauffenbergstrasse 43, D-8600 Bamberg, Fed. Rep. of Germany

[21] Appl. No.: 703,522

[22] Filed: May 21, 1991

[30] Foreign Application Priority Data

May 26, 1990 [DE] Fed. Rep. of Germany ..... 4017131

[51] Int. Cl.[5] ..... H01R 33/00

[52] U.S. Cl. ..... 362/226; 362/311; 362/353; 362/382

[58] Field of Search ..... 362/226, 800, 382, 457, 362/311, 455, 355, 353, 396

[56] References Cited

U.S. PATENT DOCUMENTS

| | | | |
|---|---|---|---|
| 3,811,042 | 5/1974 | Morrison | 362/382 |
| 4,398,240 | 8/1983 | Savage, Jr. | 362/226 |
| 4,445,164 | 4/1984 | Giles, III | 362/800 |
| 4,547,840 | 10/1985 | Tinder | 362/226 |
| 4,575,785 | 3/1986 | Lerude et al. | 362/226 |
| 4,781,960 | 11/1988 | Wittes | 362/800 |
| 4,943,898 | 7/1990 | Weenink | 362/226 |
| 4,959,761 | 9/1990 | Critelli et al. | 362/226 |

*Primary Examiner*—James C. Yeung
*Attorney, Agent, or Firm*—Jordan and Hamburg

[57] ABSTRACT

A socket for an essentially cylindrical miniature incandescent lamp for contacting mounting on a printed circuit board, with contact elements which lead into the bottom surface and which are intended to lie against the opposite contact surfaces of the printed circuit board and which can be connected with the lamp wires so as to make electrical contact. The socket is provided with a recess which extends at least as far as the vicinity of the lower, essentially flat bottom surface, for the parallel accommodation of the miniature incandescent lamp.

26 Claims, 2 Drawing Sheets

SOCKET FOR A MINIATURE INCANDESCENT LAMP

BACKGROUND OF THE INVENTION

The invention relates to a socket for an essentially cylindrical miniature incandescent lamp for contact mounting on a printed circuit board having contact elements which lead into the bottom surface, and which are intended to lie against the opposite contact surfaces of the printed circuit board and which can be connected with the lamp wires so as to make electrical contact.

Although there are possibilities for constructing them very differently in other respects, such sockets are usually constructed so that they have an essentially cylindrical accommodating part for the miniature incandescent lamp. Aside from arrangements in which the socket with the miniature incandescent lamp can be mounted directly from above on the printed circuit board, arrangements are generally provided in which the lamp can be plugged in from above or below through recesses in the printed circuit board and, if necessary, locked by twisting it into the operating position.

All of these arrangements, however, have the disadvantage that, because of the perpendicular arrangement of the miniature incandescent lamps, their height cannot be less than a certain minimum amount, that is, they require a certain minimum space above the printed circuit board.

SUMMARY OF THE INVENTION

It is therefore an object of the invention to provide a socket for a miniature incandescent lamp of the initially named type, in which printed circuit board assembly arrangements of a flatter construction can be attained.

Pursuant to the invention, this objective is accomplished owing to the fact that the socket is provided with a recess for the parallel accommodation of the miniature incandescent lamp, the recess extending at least as far as the vicinity of the lower, essentially flat bottom surface and preferably being constructed as a light reflector.

Due to the inventive construction, the height necessary for a combination of socket and miniature incandescent lamp can be reduced practically to the diameter of the miniature incandescent lamp, which in practice is less than the height of the miniature incandescent lamp. Theoretically, the recess can extend so far, that it ends at least as a line in the bottom surface. In this case, the minimum total height of the miniature incandescent lamp, which is provided with a socket, is then actually achievable. In order to lose as little light as possible with such an arrangement, provisions are made pursuant to the invention not only that the recess be constructed as a light reflector, which can be accomplished, for example, by an appropriate, white plastic housing or also by a reflective coating of the recess, but also preferably that the depth of the recess be selected, so that it is less than or equal to half the diameter of the miniature incandescent lamp. In this manner, a half or more of the miniature incandescent lamp protrudes upwards from the socket and can accordingly emit its light not only upwards but also towards the side. Only in cases in which the miniature incandescent lamp is to illuminate essentially only in a direction perpendicular to the printed circuit board, for example, for back lighting an indicator panel disposed above it, would it be advisable to select a recess of greater depth in order, in conjunction with the reflecting construction, to permit the light to emerge directed as far as possible only upwards.

Aside from a construction of the recess essentially corresponding to the shape of the miniature incandescent lamp arranged in parallel form for which, however, the relatively large manufacturing tolerances of the miniature incandescent lamps must of course be taken into consideration, it has proven to be advantageous, in a further refinement of the invention, to construct the recess in such a manner that, after the miniature incandescent lamp is inserted, there is space for accommodating an adhesive in order to fix the lamp in the recess with the help of this adhesive.

In order to be able to mount the inventive socket with the therein contained miniature incandescent lamp as rapidly and simply as possible on the printed circuit board and to secure it there so as to make electrical contact, provisions are made in a further development of the invention to provide the socket on the end opposite the contact elements with support knobs, the height of which corresponds to the projection of the contact elements over the bottom surface. In this manner, the greater part of the bottom surface is disposed at a slight distance from the printed circuit board. This opens up the possibility for applying a spot of adhesive on the bottom surface, with the help of which the socket is reliably fixed when placed on the printed circuit board. It is then finally fixed in position by wave soldering by means of which the electrical connection between the opposite contact surfaces of the printed circuit board and the contact elements of the socket is then also established.

The contact elements can be constructed in different ways. For example, they can be rivets which wedge the lead wires so as to make electrical contact in transverse boreholes which run from top to bottom, or also L-shaped contacting parts which are inserted in such transverse boreholes and the one leg of which lies against the bottom surface. In addition to these, there is also a construction which can be produced very simply and also automatically and for which the contact elements are U-shaped clips which encircle the socket, wedging the connecting wires which run along the upper side.

Further advantages, characteristics and details of the invention arise out of the following description of some embodiments as well as from the drawings.

DESCRIPTION OF THE PREFERRED EMBODIMENTS

Figure 1:
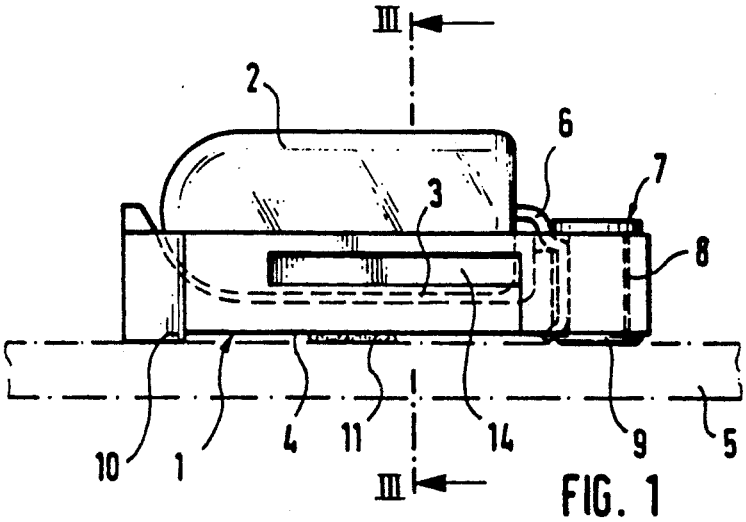
FIG. 1 is a side view of an inventive socket with a parallel, inserted, miniature incandescent lamp.
Figure 2:
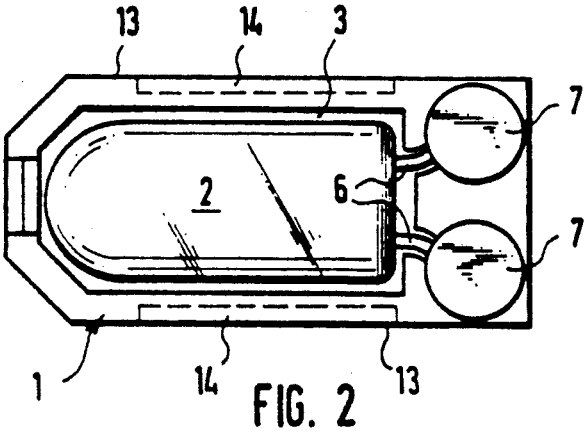
FIG. 2 is a plan view of the arrangement of FIG. 1.
Figure 3:
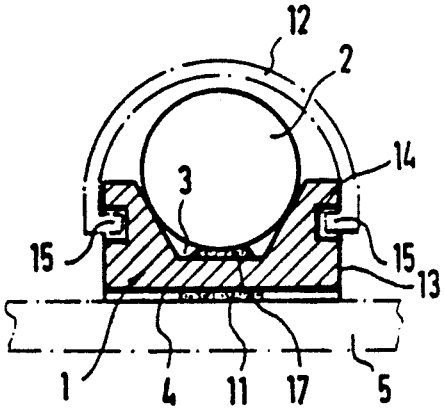
FIG. 3 is a sectional view taken along the line III—III in FIG. 1.

A socket 1 for an essentially cylindrical miniature incandescent lamp 2 of FIGS. 1 to 3 is constructed essentially as a flat cuboid with a recess 3 in which the miniature incandescent lamp 2 can be inserted in parallel fashion. In this connection, it is of decisive importance that the recess 3 essentially extends into the socket 1 in the direction of the lower bottom surface 4, such that the distance between the bottom of the recess 3 and the bottom surface 4 is relatively small. Optionally, provisions can even be made so that the recess 3 is at least partially open in the bottom surface. In this manner, a component with a minimum overall height results. In an extreme case. this height can be reduced to the diameter of the miniature incandescent lamp 2. This is in contrast to the prior art arrangements in which the miniature incandescent lamp 2 was always mounted in a perpendicular position in the socket so that, especially if the light is to be brought out completely from the miniature incandescent lamp, the necessary overall height above the printed circuit board 5 must always be greater than the height of the miniature incandescent lamp which is always significantly greater than the diameter.

The recess 3, moreover, is constructed so as to be reflecting. In the simplest case, this can be accomplished, due to the fact that the socket is injection molded, by using a white plastic material. For particularly expensive cases and in order to utilize the light produced completely, the recess 3 can, however, also be provided with a mirror-coated surface. As can be seen from FIG. 3, the shape of the recess 3 does not correspond precisely to a circular segment. On the one hand, this opens up the possibility of absorbing the size and diameter tolerances of the miniature incandescent lamps 2. On the other hand, this creates space for introducing a little adhesive 17 with the help of which the miniature incandescent lamp is held in the recess 3.

In the embodiments of FIGS. 1 to 3, rivets 7 are provided, for establishing electrical contact with connecting leads 6 of the lamp. These rivets 7 wedge the connecting leads 6 in the transverse boreholes 8 of the socket 1 and therefore hold the connecting leads 6 mechanically and, as well, establish electrical contact with them. The lower, rounded end surface 9 of the rivet extends beyond the bottom surface of the socket. In the embodiments of FIGS. 1 to 3, this is utilized further owing to the fact that the socket 1 is also provided on the opposite end side with support knobs 10 which correspond to the projecting length of the end surfaces 9 of the rivet. In this manner, the bottom surface of the socket is a small distance from the printed circuit board 5 when the printed circuit board 5 is mounted. A very simple preliminary fixing is therefore possible, owing to the fact that a spot of adhesive 11 can be applied on this bottom surface 4. This spot of adhesive can spread in the space between the printed circuit board and the bottom surface so that it also does not matter how large the spot of adhesive 11 is.

An additional refinement of the socket for the embodiment of FIGS. 1 to 3 permits the addition of an optionally colored hood 12 in order to be able to radiate a light, which is colored as required, using a simple white lamp. For this purpose, longitudinal grooves 14, into which appropriate ribs 15 of the hood 12 can be spring mounted, are provided in the longitudinal side walls 13 of the socket.

Figure 4:
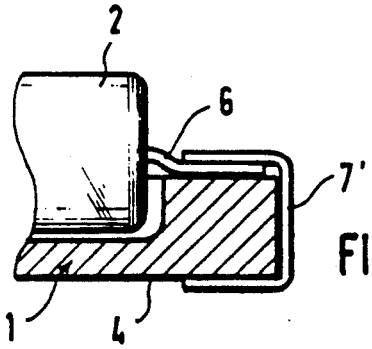
FIG. 4 is a partial sectional view taken through a socket in the region of one of the contact elements with a modified embodiment of the contact elements.

FIG. 4 shows a modified embodiment of an inventive socket in which U-shpaed clips 7' are provided instead of rivets for forming contact elements. These U-shaped clips 7' encircle the socket and wedge in place the contact wires 6 lying on it. Thus, the connecting leads are mechanically fixed in position and also contacted electrically.

Figure 5:
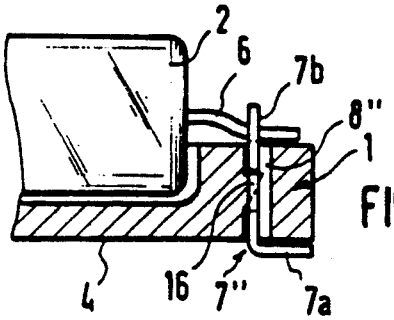
FIG. 5 is a sectional view corresponding to that of FIG. 4, showing a third embodiment of the contact elements.
Figure 6:
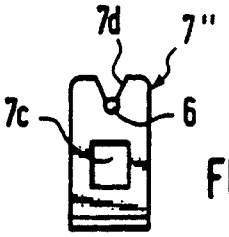
FIG. 6 is a view of the contact element offset by 90° compared to the representation in FIG. 5.

FIGS. 5 and 6 show a further variation of an embodiment with essentially L-shaped contact parts 7'' which are inserted from below through transverse boreholes 8'' in the socket 1, so that their one leg 7*a* lies along the bottom surface 4 of the socket 1. The second leg 7*b* is provided with a recess 7*c* in which an arresting hook 16, which is integrally molded in the transverse borehole 8'', catches. The connecting leads 6 of the lamp finally are wedged in the slots 7*d* of the L-shaped contact element 7''.

Figure 7:
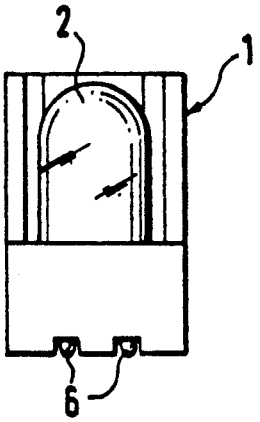
FIGS. 7 to 9 are a plan view, a side view and a view from below of a fourth embodiment of an inventive socket with a parallel, miniature incandescent lamp.
Figure 8:
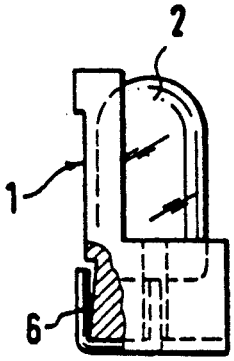
Figure 9:
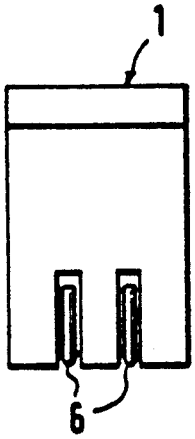

FIGS. 7 to 9 shows an embodiment of an inventive socket with a parallel miniature incandescent lamp. In this embodiment, one side of the socket is raised and accommodates one end of the miniature incandescent lamp. This embodiment is particularly suitable for the colored layouts of display lamps, since light does not emerge from the corresponding end face and with that, a colored covering is also not required on this side. Moreover, with this embodiment, the construction of the contacting elements is simplified owing to the fact that the connecting leads of the lamp are pulled through longitudinal boreholes in the end wall and bent twice at right angles in grooves. The depth of the grooves, at least on the underside, is less than the thickness of the wire, so that the wire can, in any case, project beyond the bottom surface of the socket so as to make contact.

Figure 10:
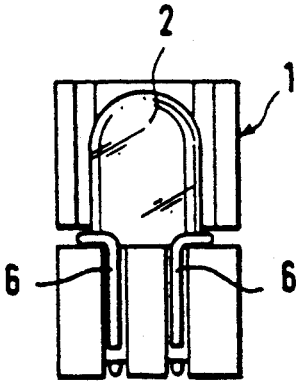
FIGS. 10 to 12 are a plan view, a side view and a view from below of a fifth embodiment with a modified construction of the contact elements.
Figure 11:
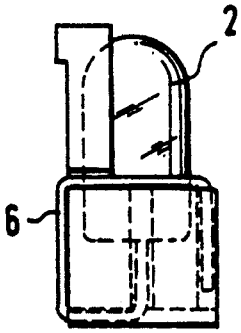
Figure 12:
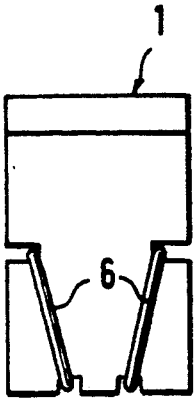

The arrangement of FIGS. 7 to 9 is suitable only for miniature incandescent lamps in which the connecting leads of the lamps have at least a certain minimum thickness of about 0.3 mm. For lamps with thinner connecting leads, there must be more extensive wrapping around the end wall, as shown in FIGS. 10 to 12. After they are bent twice at right angles on the underside, the connecting leads of the lamp are pulled upwards again and finally wedged on the upper side in a groove. In this case, it is the multiple wrapping and not the wedging effect that produces the actual holding function.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What I claim is:

1. A miniature incandescent lamp assembly for contact mounting on a printed circuit board comprising a socket having an elongate recess, a miniature incandescent cylindrical lamp disposed in said recess, said socket having a bottom adapted to be disposed juxtaposed to a printer circuit board, said recess having a longitudinal axis that is parallel to said bottom, said recess being substantially fully open on the side of said axis that is opposite said bottom for at least a part of the length of said recess, said cylindrical lamp having an axis parallel to said bottom, electrical contact means extending from said lamp, and mounting means mounting said contact means on said socket such that a part of said contact means extends along a part of said bottom of said socket for contact with mating contacts on said circuit board.

2. A miniature incandescent lamp assembly according to claim 1, wherein said recess has a depth in the direction normal to said longitudinal axis that is less than the radius of said lamp.

3. A miniature incandescent lamp assembly according to claim 1, wherein said recess has a depth substantially equal to the radius of said lamp.

4. A miniature incandescent lamp assembly according to claim 1 further comprising reflector means on said recess.

5. A miniature incandescent lamp assembly according to claim 1, wherein said recess has a bottom surface, said recess having a supporting surface supporting said lamp in a seated position in which a space is provided between said lamp and said bottom surface of said recess, and adhesive means in said space to adhesively hold said lamp in said recess.

6. A miniature incandescent lamp assembly according to claim 1, wherein said recess has sloping planar side walls and a planar bottom wall, said sloping planar side walls converging as said bottom wall is approached, said lamp being spaced from said bottom wall.

7. A miniature incandescent lamp assembly according to claim 1, wherein said socket has side walls, said longitudinal axis being midway between said side walls.

8. A miniature incandescent lamp assembly according to claim 1, wherein said lamp has one longitudinal end from which said contact means extend, said socket having support means located in a position juxtaposed to the other longitudinal end of said lamp, said bottom of said socket having a central portion, said support means extending beyond said central portion, said contact means having contact portions extending beyond said central portion a distance substantially equal to the distance that said support means extends beyond said central portion.

9. A miniature incandescent lamp assembly according to claim 8, wherein said central portion of said socket bottom is spaced from said circuit board, and adhesive means in said space between said central portion of said socket bottom and said circuit board for adhesively securing the lamp assembly on said printed circuit board.

10. A miniature incandescent lamp assembly according to claim 1, wherein said socket has passages extending perpendicular to the axis of said lamp, said contact means comprising rivets in said passages, said contact means further comprising leads extending into said passages and secured in said passages by said rivets.

11. A miniature incandescent lamp assembly according to claim 10, wherein said socket has a longitudinal end section extending beyond one longitudinal end of said lamp, said rivets extending through said end section to extend beyond opposite sides of said end section.

12. A miniature incandescent lamp assembly according to claim 1, wherein said socket has a longitudinal end section extending beyond one longitudinal end of said lamp, said contact means having leads juxtaposed to one surface of said end section, said contact means further comprising U-shaped clips clipped onto said end section and holding said leads on said one surface.

13. A miniature incandescent lamp assembly according to claim 12, wherein said one surface is a top surface, said end section having a bottom surface parallel to said top surface, said U-shaped clip having spaced legs extending over said top and bottom surfaces, said leads being disposed between said top surface and one of said legs.

14. A miniature incandescent lamp assembly according to claim 1, wherein said socket has a longitudinal end section extending beyond one longitudinal end of said lamp, said end section having passages extending generally perpendicular to the axis of said lamp, said contact means extending through said passages.

15. A miniature incandescent lamp assembly according to claim 14, wherein said end section has a top surface and a bottom surface between which said passages extend, said contact means comprising a lead extending from said one longitudinal end of said lamp to a position overlying said top surface, said contact means further comprising an L-shaped member having one leg passing through said passage and contacting said lead, said L-shaped member having another leg underlying said bottom surface.

16. A miniature incandescent lamp assembly according to claim 1, wherein said socket has a longitudinal end section extending beyond one longitudinal end of said lamp, said contact means comprising elongated contact elements bent at right angles about said end section.

17. A miniature incandescent lamp assembly according to claim 16, wherein said end section has passages extending parallel to the axis of said lamp, said contact elements extending through said passages.

18. A miniature incandescent lamp assembly according to claim 16, wherein there are two of said contact elements each having two right angle bends.

19. A miniature incandescent lamp assembly according to claim 16, wherein there are two of said contact elements each having three right angle bends.

20. A miniature incandescent lamp assembly according to claim 16, wherein said contact elements extend to the bottom of said socket.

21. A miniature incandescent lamp assembly according to claim 16, wherein said end section has a bottom and a top wall parallel to said bottom wall, the spacing between said top and bottom walls being greater than the diameter of said lamp.

22. A miniature incandescent lamp assembly according to claim 16, wherein said end section has a bottom and a top wall parallel to said bottom wall, the spacing between said top and bottom walls being less than the diameter of said lamp.

23. A miniature incandescent lamp assembly according to claim 1, wherein said socket has a longitudinal end section extending beyond one longitudinal end of said lamp, said contact means comprising contact elements wrapped around said longitudinal end section.

24. A miniature incandescent lamp assembly for contact mounting on a printed circuit board comprising a socket having an elongate recess and a bottom, said recess having a longitudinal axis that is parallel to said bottom, a miniature incandescent cylindrical lamp disposed in said recess, said recess being substantially fully open on the side of said axis that is opposite said bottom for at least a part of the length of said recess, said recess having a depth in the direction normal to said longitudinal axis that is less than the radius of said lamp, said cylindrical lamp having an axis parallel to said bottom, electrical contact means extending from said lamp, said socket having aperture means, said contact means extending through said aperture means on said socket from said lamp and being directed therefrom along said part of said bottom of said socket for contact with mating contacts on said circuit board.

25. The miniature incandescent lamp assembly of claim 24 wherein said contact means comprises leads extending axially from said lamp, said leads extending through said aperture means and being bent to extend along said part of said bottom of said socket.

26. The miniature incandescent lamp assembly of claim 24 wherein said socket circumferentially surrounds a part of said lamp.

* * * * *